United States Patent [19]

Friedman

[11] Patent Number: 5,042,841

[45] Date of Patent: Aug. 27, 1991

[54] COMBINED COVER AND STORAGE COMPARTMENT FOR A RING BINDER

[76] Inventor: Michael N. Friedman, 7 Harbor Ct., Centerport, N.Y. 11721

[21] Appl. No.: 483,131

[22] Filed: Feb. 22, 1990

[51] Int. Cl.[5] ..... B42D 3/00

[52] U.S. Cl. ..... 281/29; 281/27.1; 281/31; 402/75; 402/79

[58] Field of Search ..... 402/60, 61, 62, 70, 402/73, 74, 75, 76, 77, 78, 79, 80 R; 281/27.1, 27.2, 27.3, 28, 30, 40, 29, 38, 31, 2, 5, 8; 40/401, 402, 403, 404, 405; 229/126; 383/84; 283/62

[56] References Cited

U.S. PATENT DOCUMENTS

| | | | |
|---|---|---|---|
| D. 275,576 | 9/1984 | Kirk | D19/33 |
| 1,084,349 | 1/1914 | Krumming | 40/404 |
| 2,259,787 | 10/1941 | Trussell | 40/402 |
| 2,677,376 | 5/1954 | Brunner | 402/79 |
| 3,797,152 | 3/1974 | Brandt | 40/404 |
| 4,516,871 | 5/1985 | Leitman | 283/40 |
| 4,519,626 | 5/1985 | Podosek | 281/27.2 |
| 4,573,821 | 3/1986 | Gilreath | 281/38 |
| 4,588,321 | 5/1986 | Egly | 402/77 |
| 4,795,287 | 1/1989 | Friedman | 402/79 |
| 4,893,839 | 1/1990 | Podd et al. | 281/38 |

FOREIGN PATENT DOCUMENTS

| | | | |
|---|---|---|---|
| 370696 | 4/1932 | United Kingdom | 402/79 |
| 518849 | 4/1940 | United Kingdom . | |
| 2187140 | 3/1987 | United Kingdom | 402/76 |

*Primary Examiner*—Douglas D. Watts
*Assistant Examiner*—Eugenia A. Jones
*Attorney, Agent, or Firm*—Bauer & Schaffer

[57] ABSTRACT

A combined cover and storage compartment for a ring binder which comprises an envelope which can be closed on all sides to protect the contents thereof from falling out, while at the same time, providing easy access thereto when desired.

7 Claims, 2 Drawing Sheets

COMBINED COVER AND STORAGE COMPARTMENT FOR A RING BINDER

BACKGROUND OF THE INVENTION

This invention relates to a ring binder and more particularly, to a cover for a ring or spiral binder having combined therewith a secure storage compartment.

Ring binders of both the loose-leaf and non-opening spiral types are very efficient in holding holed or perforated pages. They are however, frequently inconvenient and difficult to use to hold loose papers, pages, booklets or multipage materials free of the ring or spiral. Such loose pages and booklets are merely placed between the cover and pages of the binder and thus, tend to be dislodged and fall out of the binder during transport. Some ring binders have been provided with pouches or envelopes to hold loose material. For example, the U.S. Pat. No. 4,519,629 to Podosek discloses a cover having a pocket open along the free edge opposite the ring spine. The cover is formed with a flap that is folded around the open edge for ultimately closing the pocket. However, this folder construction exhibits a drawback in that the contents of the pocket are free to fall out once the book is opened for use, since the flap itself opens outwardly.

In the applicant's U.S. Pat. No. 4,795,287 the cover is provided with an open half pocket for receiving flat loose papers of a size equal to the size of the cover. Access to papers held in the pocket is restricted due to the provision of a small tab in a corner of the cover opposite the pocket. This contruction leaves a large proportion of the paper visible and easy to retrieve, but is not suitable for folded papers, booklets or small sheets.

U.S. Pat. No. 2,677,376 discloses a separately formed transparent pocket for disposition in a ring binder in a similar manner to the holed paper. U.S. Pat. No. 4,516,871 discloses a similar envelope having projecting tabs and Design Patent 275,576 discloses a ring binder insert in the form of a file folder having peripheral edge flaps.

While the above-mentioned patents disclose inventions which are useful for the purposes for which they were intended, they still exhibit the drawbacks or disadvantages discussed, or simply provide inserts for ring binders which are flap type folder structures of one sort or another.

There exists, therefore, a need for a binder provided with a pouch, pocket or storage compartment which can store items which lack uniformity in dimension with the additional feature of keeping such items secure, but, at the same time, readily accessible to a user. It is another need to provide storage means as an integral part of the binder cover, so that the cover provides strength and rigidity both to the binder and to the storage compartment. The present invention fulfills such needs.

SUMMARY OF THE INVENTION

According to the present invention, a combined cover and storage compartment is made of an inner and an outer facing panel interconnected along three of its peripheral edges to form an envelope compartment, having an opening defined by the free edges of the panels. One of the panels is provided with holes parallel to its free edge so that the envelope can be retained within the ring or spiral binder. A flap is provided having an edge provided with a plurality of holes so that it can also be retained in the ring binder and is freely to overlie the opening of the pocket.

In this manner, the opening to the compartment is always adjacent the spine of the binder so that, with the binder open or closed, dislodgement or loss of papers from the compartment is restricted.

In the preferred embodiment, the envelope is die cut from a blank of unitary sheet material folded into two adjoining substantially congruent panels. One of the panels is provided with integral gussets along the lateral edges while the second panel provided with slits for the reception of the gussets when the panels are disposed opposite each other in a folded relationship. The gussets provide depth to the compartment equal to the size of the gussets. Preferably the entire cover and compartment are made from relatively heavy stock to provide a rigid substantially non-deformable cover even when filled. It may, however, be formed from an integral extension of the first panel of the blank and cut free thereof during formation of the remainder of the cover. Cooperative fastening means are disposed on the closure flap and the second panel providing easy access to and closure of the storage pocket.

Various modifications are possible and full details of the invention are set forth in the following description and illustrated in the accompanying drawings.

THE DRAWINGS

DESCRIPTION OF THE PREFERRED EMBODIMENTS

Figure 1:
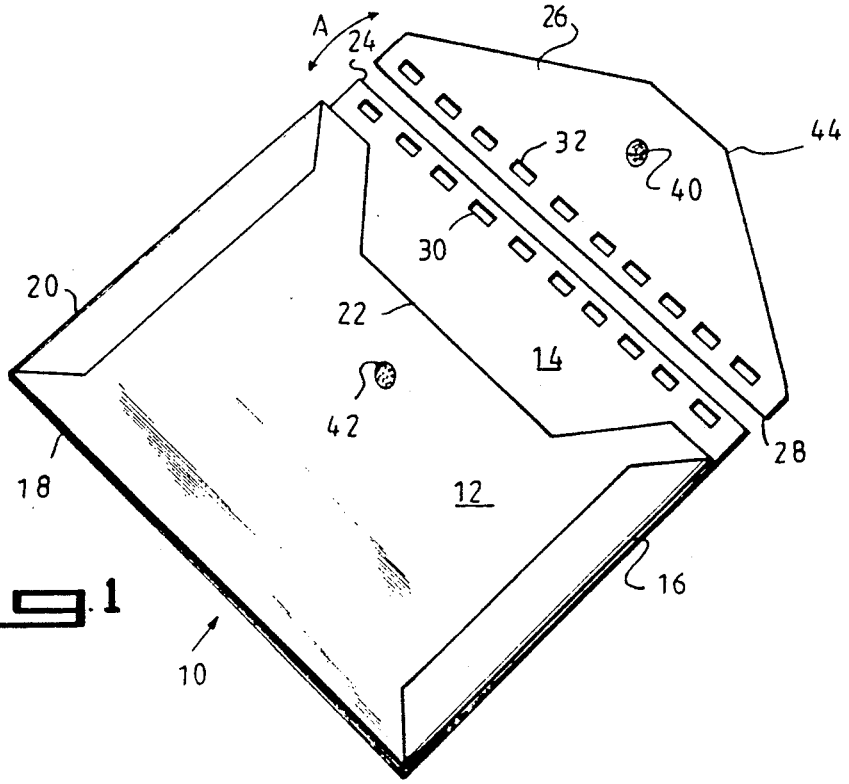
FIG. 1 is a perspective view of a combined cover and storage compartment embodying the present invention.

As seen in FIG. 1, the combined cover and storage compartment generally depicted by the numeral 10 comprises a pair of generally rectangular panels 12 and 14 arranged in opposition to each other with integrally formed side walls 16, 18 and 20 along three sides so as to define a pocket having an opening 22. The lower panel 14 extends beyond the pocket opening 22 and terminates in a free edge 24, in opposition to which is provided a separate closure flap 26. The flap 26 is provided with an edge 28 spaced from and parallel to the edge 24 so that when it is foldable about an imaginary line parallel thereto, as illustrated by arrow A, the flap 26 will overlie and close the pocket opening 22.

A row of holes 30 and 32 are provided on each side of and parallel to the edges 24 and 28, respectively. The holes 30 and 32 are paired and shaped so as to be insertable in the rings or spiral of the spine of the binder as will be seen in FIG. 2.

Figure 2:
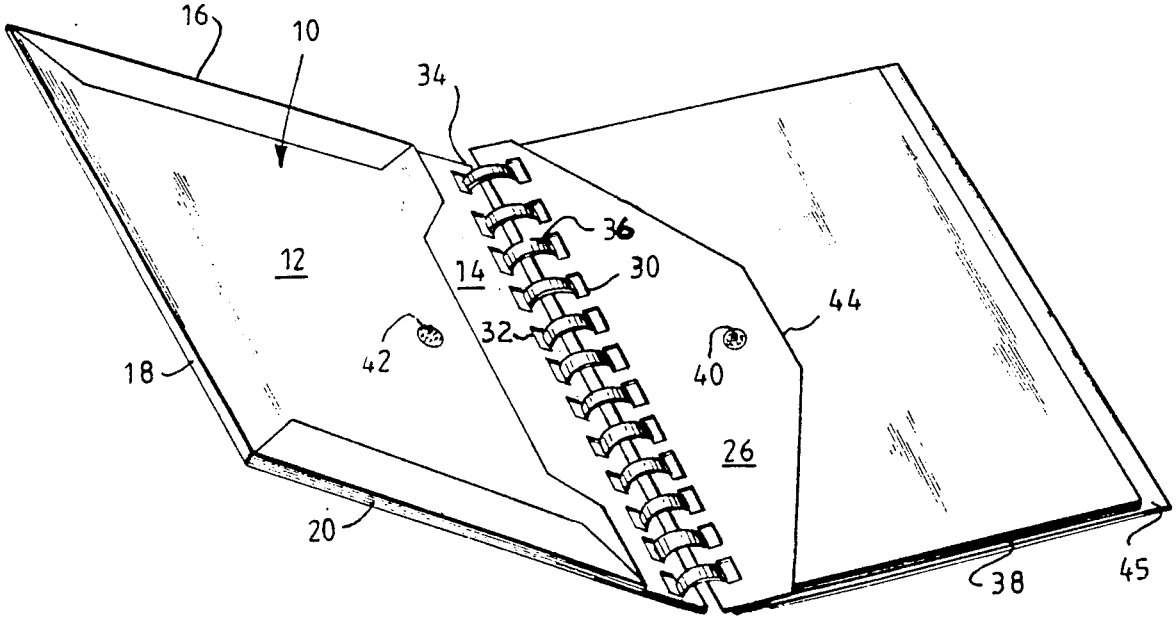
FIG. 2 is a perspective view of a ring binder provided with the combined cover and storage compartment illustrated in FIG. 1.

In FIG. 2, the cover 10 of the present invention is illustrated as the front cover of a binder, generally depicted by the numeral 34, having a spiral spine 36 of the type sold under the trademark KOMTRAK, by the I & M Bindery, Plainview, NY. The combined cover and compartment 10, as well as flap 26 are attached to the spine 36 by winding the spiral through the paired holes 30 and 32 in the same manner as the conventional content paper 38 is inserted therein. In fact, the inventive cover may be thus attached simultaneously with the paper 38, if desired.

Since the paired holes 30 and 32 are aligned when the flap 26 overlies the pocket opening 22, and the flap 26 is freely and independently movable, it assumes a normal flat position over the paper 38 and will automatically close the pocket opening 22 when flipped over or when the binder 34, as a whole, is closed. Even when the binder 34 is subsequently opened, the flap 26 will remain closing the pocket opening 22 until it is flipped back, allowing access to the pocket.

The flap 26 and the upper panel 12 may be provided with releasable closure means such as the two part "Velcro" fastener 40 and 42 or magnets. The flap 26 may be shaped to provide a pointed tab 44 which will fit under the pocket opening 22 of the upper panel, allowing closure of the pocket without use of the fastening means. The edge of the pocket opening 22 may be conformingly shaped to make the tucking of the flap 26 easier. Shaping of the edge 22 also facilitates insertion of papers or other materials into the pocket making it easy to store such items and allow ready retrieval of them.

As seen in FIG. 2, a complete ring or spiral binder 34 can be assembled employing the combined cover and compartment 10 as at least one or both of the actual covers of the binder. In FIG. 2, where only one the front cover is fashioned in accordance with the present invention, the back cover 45 may be a rigid sheet.

The combined cover and storage compartment 10, as well as the closure flap 26 of this invention, may be made from a wide variety of materials such as heavy paper bond, drafting board, inexpensive plastic sheet material and the like, which are readily available commercially. Such materials as are now commonly used in the manufacture of binders, notebooks and the like may be used and their use here would require no particular new equipment or process.

Figure 3:
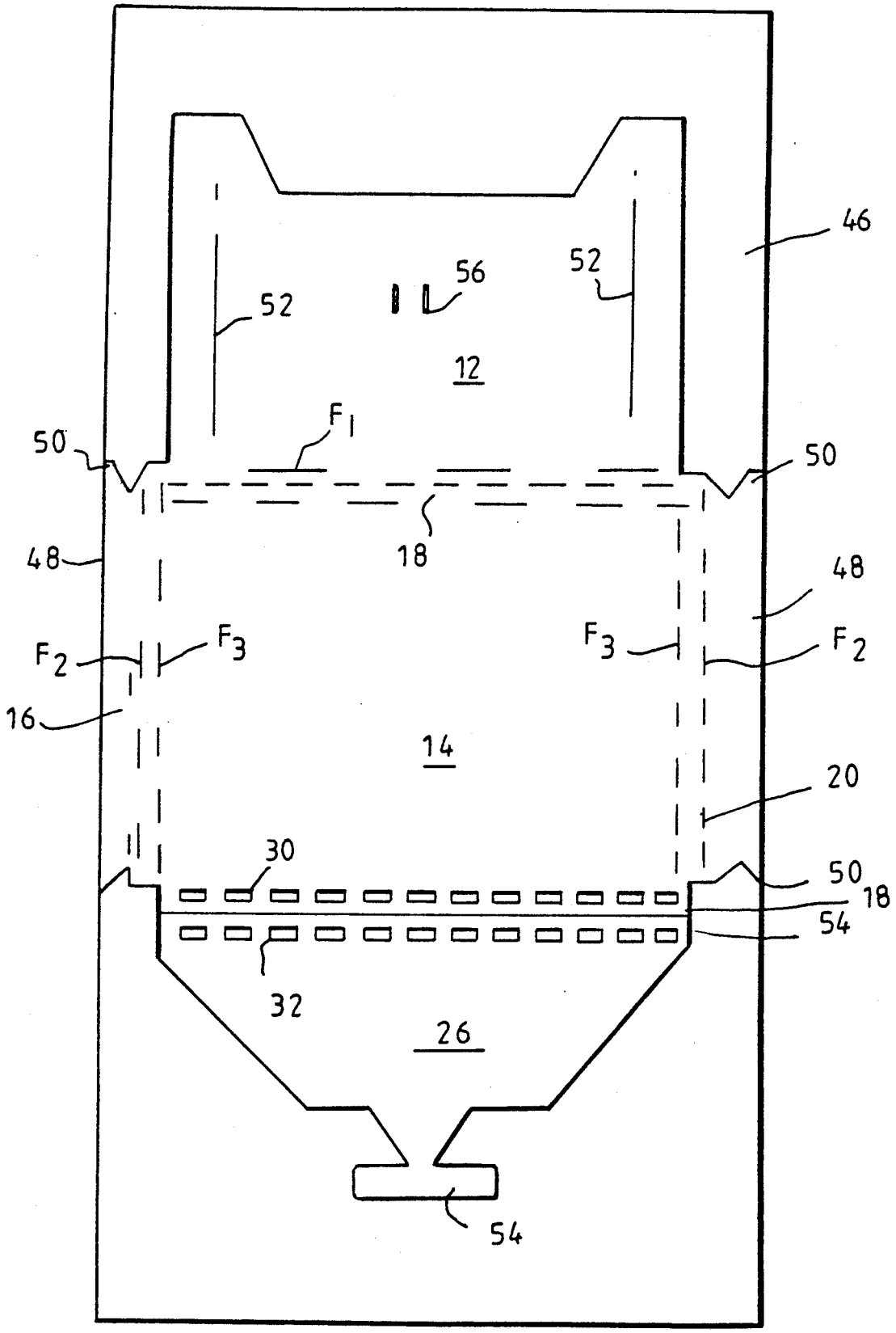
FIG. 3 is a plan view of the blank of unitary sheet material from which the combined cover and storage compartment of the present invention is formed.

The combined cover and storage compartment 10, as well as the closure flap 26 can be efficiently manufactured by commonly used die-cutting processes in the manner known in the art and, as may be seen from FIG. 3, may be made from a blank of unitary sheet material, 46. In this process, the blank 46 is cut along its periphery, shown by the solid lines, to provide the cover panel 12 and the flap 26, while providing the bottom panel 14 with extensions for the side walls 16 and 20 in the form of gussets 48. The gussets 48 are also provided with wing tabs 50 at their ends while the top panel 14 is provided with a pair of parallel slits 52 positioned inward from the side edges. The holes 30 and 32 can be simultaneously die cut. Appropriate fold lines for the erection of the side walls are established also at the same time by creases shown by the dash lines. The flap 26 is separated from the blank along a cut along line 54, also during the die cut.

In erecting the cover 10, the cut blank is first folded along crease lines Fl setting up wall 18 and overlying the panel 12 above panel 14. Thereafter, the lateral extensions and gussets 48 are folded about creases F2 and F3 setting up the side walls 16 and 20 and the gussets 48 are inserted into the respective slits 52 placing the wing tabs 50 below the surface of the panel 12 to lock the gussets into place. Thus, the pocket opening 22 is established. Thereafter, the entire assembly can be combined with the ring or spiral spine 36.

Of course, as will be obvious, the cut blank can be combined with the spiral or ring spine 36 before it is folded into erection. Also, the gussets 48 can be glued, heat sealed or otherwise secured to the surface of the panel 12, rather than being merely inserted into slits, such as shown in FIG. 2. FIG. 3 also illustrates a modification in the means of securing the closure flap 26 to the panel 12. Here, flap 26 is provided with a laterally extending pair of wing tabs 54 and the panel 12 with a pair of small slots 56 which receive the tabs 54.

It is also possible not to cut and sever the flap 26 from the lower panel 14, but to provide, if possible, a wall between the rows of holes 30 and 32. Such a wall will provide sufficient depth between panel 14 and flap 26 so that they may be confortably folded and inserted in the spiral binder and be movable relatively freely of each other and of the rings or spirals.

The binder cover including the storage compartment or envelope of the present invention presents many advantages. For example it can be used to store items of non-uniform dimensions, such as loose paper sheets, writing instruments and the like in a safe and secure manner, but which are readily accessible to a user. Still further, it may be made by known die-cutting processes from readily available materials. Numerous other advantages will be apparent to those skilled in the art.

A further advantage of the present invention lies in the fact that it may be, by selection of the size and spacing between the holes, adapted to any type of ring, spiral, loose leaf binder and not only to the KOM-TRAK type mentioned. Because the cover and compartment are made from relatively heavy stock, the binder is actually strengthened with its use and the loose papers, etc., held in the pockets are well protected and not subject to loss, creasing or other harm.

Numerous modifications of the present invention may be made without departing from the spirit and scope of the invention. It is to be understood, therefore, that this invention is not to be limited to the embodiments described hereinabove, except as defined in the appended claims.

What is claimed is:

1. A loose-leaf binder comprising a combined cover and storage envelope and a ring or spiral sheet holder formed with a spine having a spaced array of rings, said envelope formed of an inner and outer panel attached together along three edges and open along a fourth edge, a closure flap having a longitudinal edge which is generally coextensive with the fourth edge of said outer panel, each of said outer panel and said closure flap being formed with an array of spaced apertures along the fourth edge of the outer panel and the coextensive longitudinal edge of the flap, respectively, so that a given one of the apertures in each array receives concomitantly a given one of said rings of said spine whereby said outer panel forms a cover for said binder and the closure flap is foldable relatively to the inner panel to close the opening along the fourth edge of said inner and outer panels.

2. The binder according to claim 1, including cooperating fastening means on said flap and on said inner panel.

3. The binder according to claim 1, wherein the inner and outer panels are attached along the three edges by gusset means integrally formed with said inner and outer panel.

4. A loose-leaf binder comprising a combined cover and storage compartment and a ring or spiral spine, said compartment comprising an envelope formed from a blank of unitary sheet material divided into first and second adjoining panels, the first of said panels being attached along one edge to the rings of said ring binder and being provided with gussets along its other edges, and said panel being provided with gussets along its other edges, and said panel being provided with slits for the reception of said gussets when said panels are disposed opposite each other in a folded relationship; a closure flap having a longitudinal edge coextensive with the one edge of said first panel attached to the rings of said ring binder; and cooperative fastening means disposed on said closure flap and said second panel for the closure of said storage compartment.

5. The binder according to claim 4, wherein the cooperative fastening means are Velcro elements.

6. The binder according to claim 4, wherein the cooperative fastening means are magnets.

7. The binder according to claim 4, wherein the cooperative fastening means are tabs located on the closure flap and cooperating slits located in the second panel.

* * * * *